US007975594B2

(12) United States Patent
Wartmann

(10) Patent No.: US 7,975,594 B2
(45) Date of Patent: Jul. 12, 2011

(54) DEVICE FOR DEFENSE FROM PROJECTILES, PARTICULARLY SHAPED CHARGE PROJECTILES

(75) Inventor: Stephan Beat Wartmann, Güttingen (CH)

(73) Assignee: Fatzer AG, Romanshorn (CH)

( * ) Notice: Subject to any disclaimer, the term of this patent is extended or adjusted under 35 U.S.C. 154(b) by 0 days.

(21) Appl. No.: 11/668,124

(22) Filed: Jan. 29, 2007

(65) Prior Publication Data

US 2008/0164379 A1 Jul. 10, 2008

(30) Foreign Application Priority Data

Jan. 10, 2007 (EP) ..... 07405007

(51) Int. Cl.
*F41H 5/02* (2006.01)

(52) U.S. Cl. ..... 89/36.02; 89/36.08; 89/36.09; 89/36.12; 89/36.07; 89/929; 89/930; 428/911

(58) Field of Classification Search ..... 89/36.01–36.08; 109/49.5; 428/911; 114/9
See application file for complete search history.

(56) References Cited

U.S. PATENT DOCUMENTS

| | | | | |
|---|---|---|---|---|
| 1,286,261 | A * | 12/1918 | Elia | 114/9 |
| 1,385,897 | A | 7/1921 | Tresidder | |
| 1,657,915 | A * | 1/1928 | Calamita | 114/9 |
| 2,323,853 | A * | 7/1943 | Simeone | 114/9 |
| 2,954,964 | A * | 10/1960 | O'Haffey | 256/34 |
| 3,586,236 | A * | 6/1971 | Schaffler | 239/172 |
| 3,769,142 | A * | 10/1973 | Holmes et al. | 428/113 |
| 3,942,598 | A * | 3/1976 | Council | 180/6.5 |
| 3,964,197 | A * | 6/1976 | Tucker et al. | 40/584 |
| 4,787,289 | A * | 11/1988 | Duer | 89/36.02 |
| 5,524,694 | A * | 6/1996 | Arapis | 160/370.21 |
| 6,363,867 | B1 * | 4/2002 | Tsilevich | 109/49.5 |
| 6,481,782 | B2 * | 11/2002 | Bond | 296/187.07 |
| 6,568,310 | B2 * | 5/2003 | Morgan | 89/36.02 |
| 6,647,855 | B1 * | 11/2003 | Christiansen et al. | 89/36.01 |
| 6,973,864 | B1 * | 12/2005 | Ahmad | 89/36.02 |
| 7,073,538 | B2 * | 7/2006 | Bhatnagar et al. | 139/383 R |
| 7,076,898 | B1 * | 7/2006 | Hunt | 40/611.01 |
| 7,100,490 | B2 * | 9/2006 | Muller, Jr. | 89/36.02 |
| 2004/0221712 | A1 * | 11/2004 | Stewart et al. | 89/36.05 |
| 2005/0262998 | A1 * | 12/2005 | Ahmad | 89/36.02 |
| 2006/0065111 | A1 * | 3/2006 | Henry | 89/36.02 |

(Continued)

FOREIGN PATENT DOCUMENTS

| | | |
|---|---|---|
| DE | 218246 | 1/1910 |

(Continued)

OTHER PUBLICATIONS

Search report dated Jun. 18, 2007 for corresponding European patent application published as EP 1944565.

*Primary Examiner* — Stephen M Johnson
*Assistant Examiner* — Michael D David
(74) *Attorney, Agent, or Firm* — Brian Roffe

(57) ABSTRACT

A device for defense and protection from projectiles, especially shaped charge projectiles, is provided with at least one grille-type protective barrier for the protection of an object by deflection, partial release, release and/or damage to the shell projectile. The protective barrier includes a netting forming meshes that are rectangular, triangular, hexagonal, polygonal and/or rhomboid. Such a device is lighter and easier to install in comparison to conventional protective grilles.

11 Claims, 1 Drawing Sheet

U.S. PATENT DOCUMENTS

Figure 1:
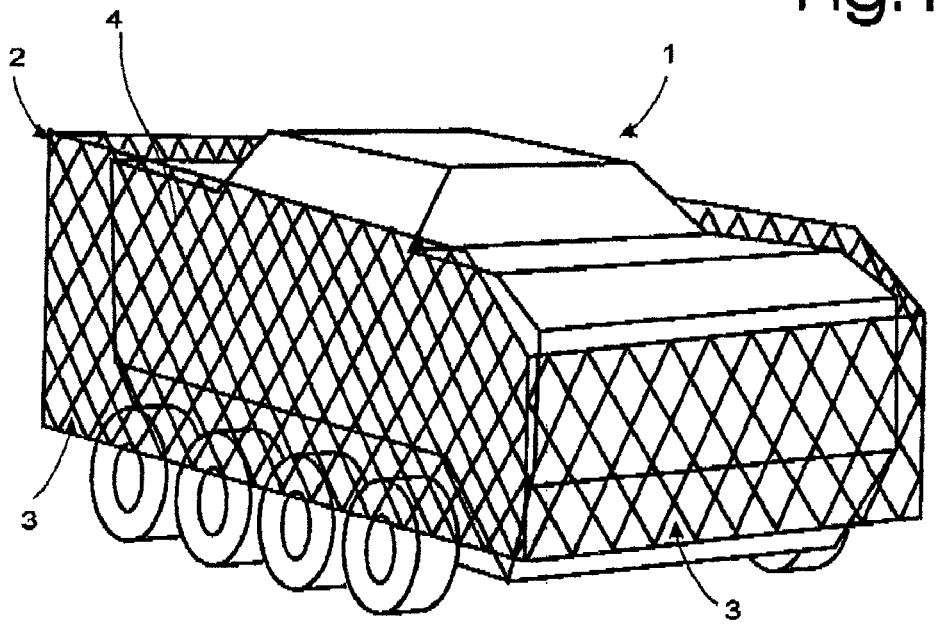

| | | | | |
|---|---|---|---|---|
| 2006/0144640 | A1 * | 7/2006 | Wartmann | 182/138 |
| 2007/0099526 | A1 * | 5/2007 | Heerden et al. | 442/135 |
| 2007/0131917 | A1 * | 6/2007 | Wartmann | 256/12.5 |
| 2007/0180983 | A1 * | 8/2007 | Farinella et al. | 89/36.07 |
| 2007/0210214 | A1 * | 9/2007 | Wartmann | 245/5 |

FOREIGN PATENT DOCUMENTS

| | | | |
|---|---|---|---|
| DE | 691067 | | 5/1940 |
| GB | 517911 | | 2/1940 |
| WO | WO 9200496 | A1 * | 1/1992 |
| WO | 2006/135432 | A2 | 12/2006 |

* cited by examiner

DEVICE FOR DEFENSE FROM PROJECTILES, PARTICULARLY SHAPED CHARGE PROJECTILES

The invention concerns a device for defense and protection from projectiles, particularly shaped charge projectiles according to the generic term of claim 1.

It is known that a kind of protective grille or several grille-like protective barriers of steel treads and steel slats and/or similar welded steel elements can be installed on military vehicles, for example, for defense from shaped charge projectiles. The purpose is to disturb the projectile and thereby put it out of order or at least to prevent its full effect. Such devices are relatively massive, mounting them is not easy (many connection parts are necessary) and they often impair visibility and reduce the payload of these vehicles by their relatively heavy weight.

The netting of this invention, in particular, offers protection against shell projectiles with shaped charges or similar warheads.

Further possibilities for using this special protective netting are in the area of protecting containers, property, perimeters, maritime facilities, ships, platforms, strengthening glass facades, etc.

It is an object of the present invention to provide a device for defense and protection from projectiles, in particular shaped charge projectiles, that is advantageous in terms of its weight, provides better visibility for the occupants when installed on a vehicle and greater security for the object to be protected.

This problem is solved in terms of an invention by a device with the features of claim 1.

Further preferred arrangements of the device of the invention are the subject of the dependent claims.

The device according to the invention for defense from projectiles, particularly shaped charge projectiles, of which a protective barrier or barriers consists or consist preferably of a rhomboid mesh-forming netting, is in comparison with conventional protective grilles essentially lighter and its installation (mounting and dismounting) is considerably simpler. Considerably fewer connecting parts are used especially when wires, cables or bars running through edge meshes and/or loop-like end elements are used. The device is easily transportable by an airplane, for example, as the wire netting can be folded or rolled up. Likewise these specific nettings, thanks to their material make-up, can be harnessed without causing deformation which simplifies installation and optimizes function.

At the same time this device offers high security in the sense that such projectiles are disturbed by this netting and thereby become virtual duds. They lose their effect because the jet of molten metal normally produced upon impact does not occur or is largely disrupted.

Additionally—when for example a military vehicle is protected by the device according to the invention—visibility is essentially better for the driver or the occupants of the vehicle than with conventional protective grilles.

Figure 2:
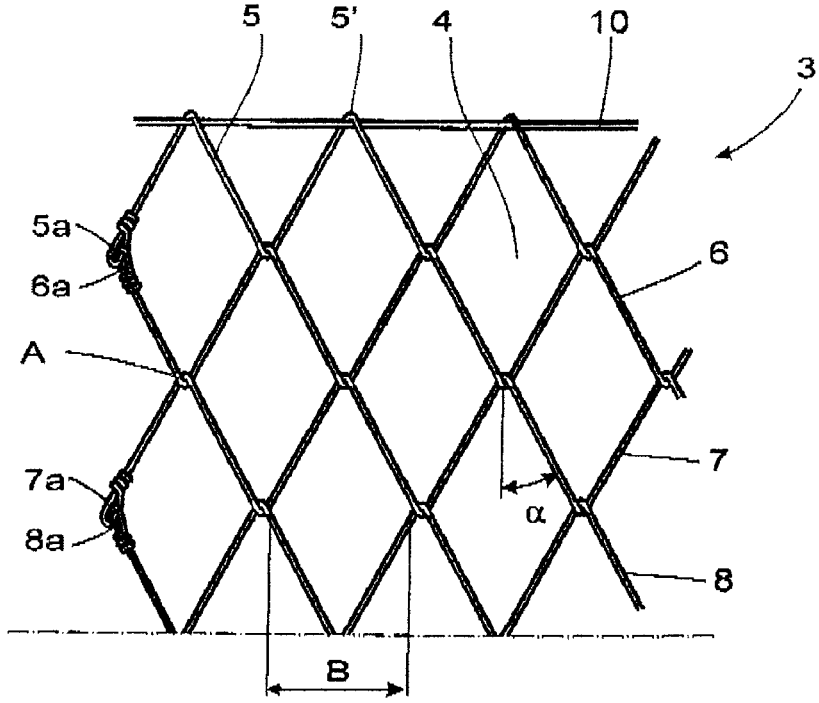

The invention will be described below in reference to the drawings:

FIG. 1 shows a military vehicle as an example of the implementation of an object to be protected from shell projectiles equipped with a device for defense from projectiles according to the invention; and FIG. 2 shows a part of the device for defense from projectiles in an enlarged scale.

In FIG. 1 a military vehicle 1 is presented as an example of an object to be protected from projectiles, particularly shaped charge projectiles, e.g. shell projectiles. It is equipped with a device 2 according to the invention for defense from projectiles. The device 2 shows several protective barriers arranged around the military vehicle 1 that consist of a wire netting 3 according to the invention. The wire netting 3 is a diagonal netting that forms rhomboid meshes 4 and is woven preferably from steel wires.

A particularly preferred implementation of the wire netting 3 is illustrated in FIG. 2. According to FIG. 2 the wire netting 3 is woven from wires 5, 6, 7, 8 bent in coils that exhibit an angle of gradient $\alpha$ (preferably 25° to 35°). Two neighboring wires 5, 6; 6, 7; 7, 8 etc. at a time are linked to each other in the area A of their bending. The wire netting 3 exhibits a three-dimensional structure with a thickness that is several times the wire thickness.

Wires 5 to 8 are provided with loops or knots 5*a*, 6*a*, 7*a*, 8*a* on their ends and are linked with each other in pairs by them.

By the link connections of the neighboring wire pairs in the linkage area A as well as in the end areas the wire netting 3 can be folded or rolled up for storage without problems.

It is also possible to form this wire netting with a middle wire between the contact points of the individual coils. A netting with an arrangement formed by two or more steel wires or wire strands is also suitable (see EP-A-1 628 790).

On the top and bottom ends of the wire netting 3 a wire, cable, bar 10 or another frame element can be looped on the edge wire 5 bent in a coil by which the wire netting 3 can be extended longitudinally and they can be fastened to the military vehicle 1. For fastening to the military vehicle 1 corresponding fasteners could certainly hold the edge wire loops 5' directly. The wire netting 3 can be fastened with similar elements running through the loops or knots 5*a*, 6*a*, 7*a*, 8*a* as well (wires, cables, bars or directly meshing fasteners).

The individual protective barriers of the device 2 can also be bordered by wire netting sections with a frame formed of bars, for example, and the device can be put together from these. Fasteners can also be formed by cables, wires or strands. Moreover, depending on use, a slightly round, conic, concave and/or convex stretching on a surface is advantageous.

The size of the rhomboid meshes 4, particularly their inner diameter (FIG. 2), is chosen so that it essentially corresponds to the maximum diameter of the shell projectiles, for which the device is expected to provide protection from, or is smaller or larger than this diameter. The shell projectile can penetrate the mesh 4 but is disturbed by contact with the netting and thus is damaged in a certain sense so that the intended explosion does not come about or takes place to a reduced degree. The three-dimensional structure of the wire netting 3 makes for a situation where, particularly with incoming shots at an angle, the likelihood that the projectile makes contact with the wire netting 3 is greater than with a flat wire netting having a thickness corresponding merely to the wire thickness.

The device according to the invention for defense from shell projectiles is essentially lighter in comparison to conventional protective grilles and its installation (mounting and dismounting) is considerably easier as fewer connecting places are used especially if the above mentioned wires, cables or bar running through the edge meshes and/or loop-like end elements are used for fastening.

The device is easily transportable by airplane, for example, since the wire netting can be folded or rolled up. Moreover, visibility for the vehicle driver or occupants is essentially better than with conventional protective grilles. The wire netting can be arranged closer to the object because of the harness in the netting as well as the optimal stretching and contortion of the special netting so that the total width of a military vehicle, for example, can be reduced which facilitates its use in cities, as an example.

Naturally, the device according to the invention for defense from shell projectiles can be applied to the protection of many other objects besides military vehicles or movable objects. Strategically important objects, such as monitored entrances, can be equipped with the device according to the invention (in that case, a single protective barrier would probably suffice) or other objects can be only temporarily protected.

It is especially advantageous to produce the wire netting from wires that consist of reinforced steel with a nominal strength between 1,000 and 3,000 N/mm$^2$, or between 900 and 3,000 N/mm$^2$, and it can be spring steel wires of the DIN-norm 17223. This allows one to use essentially thinner wires with equal strength by which the likelihood that a shell projectile will come in frontally with the detonation element directly on a wire and thus bringing about a full explosion is decreased. Moreover, the total weight of the device according to the invention is further reduced and visibility for the vehicle driver or occupants, for example, is further ameliorated.

The mesh size of a netting 3 can be carefully chosen such that the netting performs the function of a protective shield. Upon impact of a shell projectile a detonation always or at least most of the time ensues. But because of a sufficient distance of the netting to the object 1 damage to the object can be prevented or very much reduced. The mesh size or the inner diameter of the netting is preferably less than 30 mm in such a case.

Instead of individual, preferably coil-shaped bent wires wire elements such as wire strands, wire cables, wire bundles or the like may also be used for the wire netting 3.

The netting 3 can basically consist of rectangular, triangular, polygonal and/or rhomboid meshes 4. It can also have a honeycomb form or hexagonal formation as in hedge fencing. It is further possible that such netting structures can be formed or otherwise produced from plastics and or partly from plastics and/or partly from combined materials which then could give the already mentioned mesh formations.

Basically such a netting can be understood as one which is formed as a grid as is explained, for example, in EP-A-0 679 457.

The invention claimed is:

1. A device for the defense and protection of a vehicle from projectiles in combination with the vehicle, comprising:

at least one grille-type protective barrier comprising a netting forming meshes having openings into which the projectiles can enter and positionable alongside the vehicle to reduce the possibility of projectiles impacting the vehicle, wherein the netting is woven from a plurality of individual members extending generally in a common direction, the members being wires, steel wires, cables, cords and/or synthetic materials or produced from plastic, at least one of the members linking with a first, laterally adjacent one of the members on one side at a plurality of spaced apart locations and linking with a second, laterally adjacent one of the members on an opposite side at a plurality of spaced apart locations to thereby form the woven netting, and wherein the netting forms a plurality of protective barriers for the vehicle and is attached to the vehicle, and wherein the individual protective barriers are formed by netting sections that are bordered by a respective frame such that each of the plurality of protective barriers is bordered by a respective frame and one of the protective barriers is bordered by a first frame of one shape on one side of the vehicle and another one of the protective barriers is bordered by a second, differently shaped frame on another side of the vehicle.

2. The device according to claim 1, wherein the first and second frames are arranged on opposite sides of the vehicle.

3. The device according to claim 1, wherein at least one of the protective barriers further comprises wires, cables or bars arranged to attach the netting to the vehicle such that the netting is alongside the vehicle, the wires, cables or bars running through meshes at at least one edge of the netting.

4. The device according to claim 1, wherein the members have a coil shape providing the members with a zig-zag path in the common direction.

5. The device according to claim 1, wherein the members are in contact with one another when they link at the plurality of spaced apart locations.

6. The device according to claim 1, wherein all of the protective barriers further comprise wires, cables or bars arranged to attach the netting to the vehicle such that the netting is alongside the vehicle, the wires, cables or bars running through meshes at at least one edge of the netting.

7. The device according to claim 1, wherein the first and second frames are arranged on adjacent sides of the vehicle, the first and second frames having a common portion.

8. The device according to claim 1, wherein the at least one of the members linked with the first, laterally adjacent member is linked in direct contact only with that first, laterally adjacent member on that side at the plurality of spaced apart locations and linked with the second, laterally adjacent member is linked in direct contact only with that second, laterally adjacent member on the opposite side at the plurality of spaced apart locations.

9. The device according to claim 1, wherein the members are linked such that spaces are formed in the netting between the spaced apart locations at which adjacent members are linked to one another, the spaces being defined only by portions of the linked members.

10. The device according to claim 1, wherein the netting is attached to the vehicle at a distance between the netting and the object that reduces damage to the object when the netting is impacted by a projectile.

11. The device according to claim 1, wherein the frame of each protective barrier comprises at least one elongate cable or bar about which a respective one of the members at the edge of the protective barrier is looped.

* * * * *